United States Patent [19]

Phillips et al.

[11] 4,259,006

[45] Mar. 31, 1981

[54] AIR JET MEANS FOR REMOVING LIQUID FROM A CONDUCTIVE SURFACE

[75] Inventors: Edwin R. Phillips, Rosemont; Raymond J. Stankiewicz, Philadelphia, both of Pa.

[73] Assignee: Sperry Corporation, New York, N.Y.

[21] Appl. No.: 67,980

[22] Filed: Aug. 20, 1979

[51] Int. Cl.[3] ..... G03G 15/10

[52] U.S. Cl. ..... 355/10; 118/63; 118/662

[58] Field of Search ..... 355/10, 3 R; 118/662, 118/660, 63; 430/117–119

[56] References Cited

U.S. PATENT DOCUMENTS

| | | | |
|---|---|---|---|
| 2,766,720 | 10/1956 | Müller et al. | 118/63 |
| 3,851,964 | 12/1974 | Smith et al. | 430/117 X |
| 3,957,016 | 5/1976 | Yamada et al. | 355/10 X |
| 4,168,119 | 9/1979 | Nishimura et al. | 355/10 |
| 4,181,094 | 1/1980 | Gardiner | 118/63 X |

*Primary Examiner*—Richard L. Moses

*Attorney, Agent, or Firm*—Thomas J. Scott; William E. Cleaver; Edward M. Farrell

[57] ABSTRACT

An electrostatic copying machine includes a reservoir for liquid developer made up of toner particles in a dispersant. A photoconductive drum, adapted after receiving a latent electrostatic image thereon to pass through the liquid developer in the reservoir and to have an electrostatic image developed on the drum. A metering roller for removing excess dispersant is positioned between the reservoir and an air knife which projects a sharp thin jet of pressurized air at about a 45 degree angle with respect to the surface of the drum. The air pressure produced by the air knife drives any remaining spent dispersant on the surface of the drum back to the reservoir by way of the metering roller and the latent image on the drum is subsequently transferred to paper.

2 Claims, 5 Drawing Figures

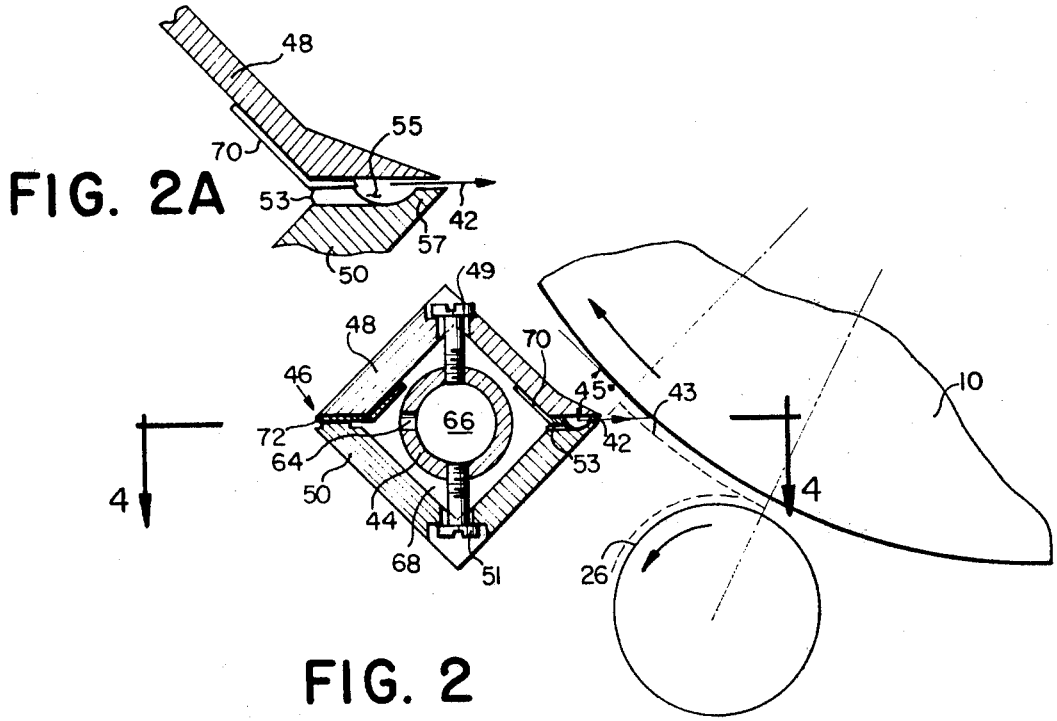
FIG. 2A
FIG. 2
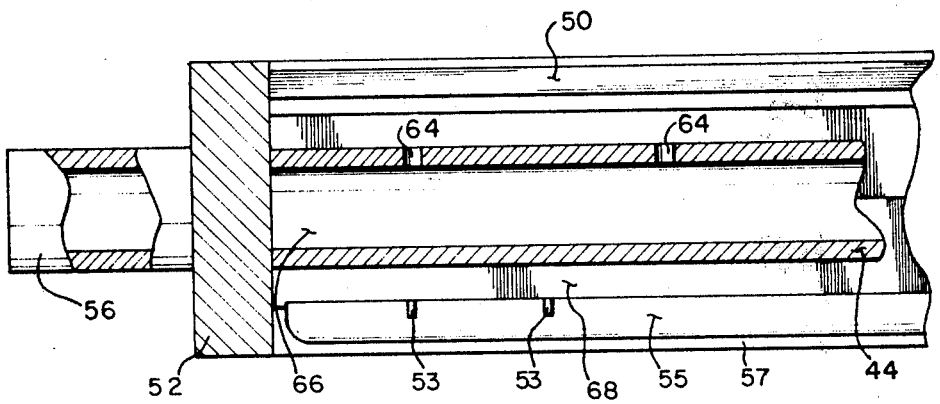
FIG. 4

AIR JET MEANS FOR REMOVING LIQUID FROM A CONDUCTIVE SURFACE

BACKGROUND OF THE INVENTION

The use of electrophotographic copiers as computer output printing devices is well known. In one such system, with which the present invention is related, a liquid electrostatic copier includes a rotatable drum which has a photoconductive surface. The surface of the drum is first moved past a charging station. An image to be copied is then projected onto the drum at an exposure station. After leaving the exposure station, the drum has a latent electrostatic image thereon. The drum then moves through apparatus which includes a liquid developer having charged toner particles suspended in a suitable carrier liquid or dispersant. The drum then leaves the liquid developer with a developed electrostatic image produced by the toner particles being attracted to the latent image on the drum. After the drum leaves the liquid developer, it is brought in contact with paper. The toner is transferred from the surface of the drum onto the paper. Electrostatic liquid developer systems of the type mentioned have been described in numerous patents and publications.

It is advantageous to remove excess liquid developer from the drum after the image has been developed. Removing the excess liquid developer from the drum reduces the amount of carrier liquid that is transferred to the paper and minimizes the likelihood of smudging of the resultant image. Furthermore, when the excess liquid developer is removed from the drum less heat is required to fix the image transferred from the drum to the paper. Additionally, as a result of reducing the amount of liquid developer transferred to the paper the quantity of vapors generated by evaporation of the carrier liquid to pollute the air is also reduced and a more precise and controllable transfer of the dry toner particles to the paper is accomplished. Removing and reusing excess dispersant is an important feature because petroleum products are used in the manufacture of dispersant and the cost of such products have been increasing dramatically.

In the prior art, absorbent rollers and driers have been used for removing the excess dispersant. It is also known to use air knives for this purpose. Such air knives utilize an air jet to blow the dispersant material off the drum while leaving the solid toner particles electrostatically retained on the electrostatic surface thereof. Air knives of this type have been disclosed in U.S. Pat. Nos. 3,741,643; 3,100,426; 3,811,765 and others. The present invention relates to such an air knife in combination with other means and methods to return the dispersant to a reservoir.

One of the considerations in using an air knife to remove excess dispersant from a drum is to provide a reliable and efficient arrangement without the use of excess power. For example, if the air jet employed is too wide, then more power is required to produce the jet and the tendency of the developed image to become distorted is increased. On the other hand, if the jet is too narrow, then the excess carrier liquid will not be removed sufficiently.

In designing an air knife, it is important that the air jet projected be uniformly distributed across a relatively wide area of the drum. If this is not done, a distortion of the image may result.

Also, it is important that the air knife alone not be relied upon to return the removed excess dispersant to a reservoir. In addition, it is desirable to remove some of the excess dispersant from the drum by metering or otherwise prior to subjecting it to the air jet from the air knife.

SUMMARY OF THE INVENTION

In accordance with the present invention, an electrostatic laser printer machine utilizing a liquid developer made up of toner particles and a liquid carrier in a reservoir is provided. A rotating drum including a photoconductive surface having a latent electrostatic image is passed through the liquid developer to produce an image thereon. A metering roller for removing excess dispersant is positioned proximate the surface of the drum between the reservoir and an air knife which is disposed at about a 45° angle with respect to the rotating surface of the drum to drive the spent dispersant back to the metering roller which returns the spent dispersant to the reservoir.

BRIEF DESCRIPTION OF THE DRAWINGS

FIG. 2 is an enlarged view of a portion of FIG. 1;

FIG. 2*a* is an enlarged view of a section of the air knife illustrated in FIG. 2;

FIG. 4 is a cross-sectional view, partly broken away, taken along lines 4—4 of FIG. 2.

DESCRIPTION OF THE PREFERRED EMBODIMENTS

Figure 1:
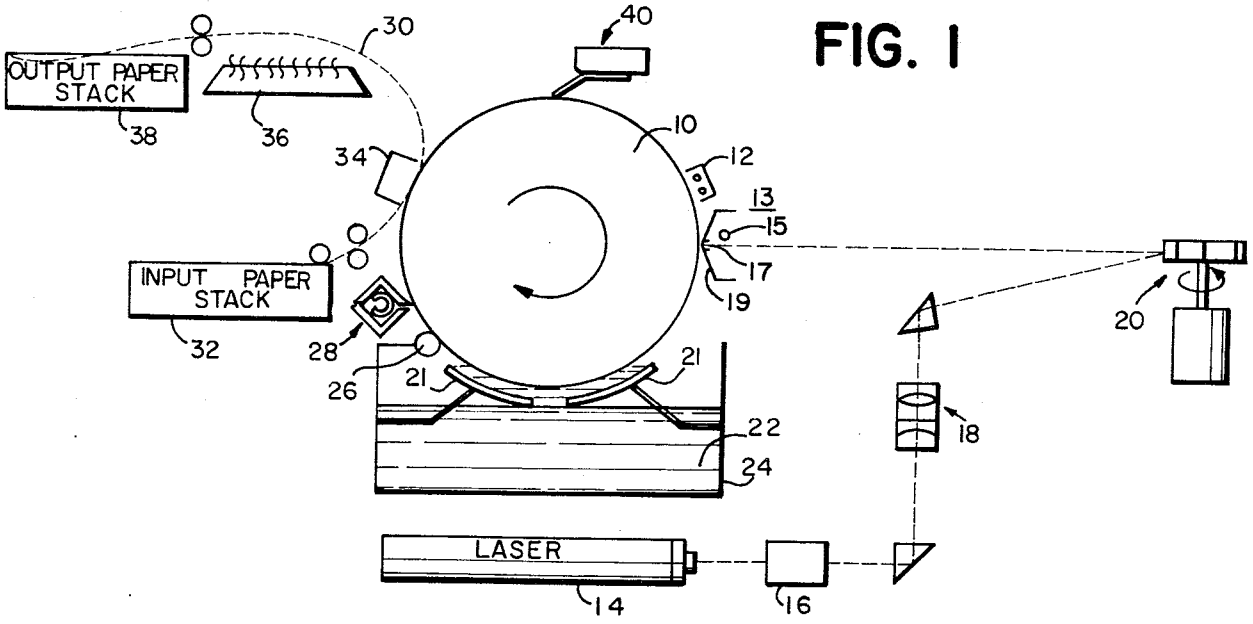
FIG. 1 is a diagram illustrating a general system in which the present invention may be used.

Referring to FIG. 1, a typical system in which the present invention may be used is illustrated. A positive corona discharge from a source 12 is applied to the surface of a rotatable drum 10 leaving the surface with a net positive charge. The data to be copied is provided in the form of modulated laser signals which are produced by a laser source 14 and a modulator 16, and coupled through a lens arrangement 18 to rotating mirrors 20. The modulated laser signals are reflected by the mirrors 20 and projected onto the photoelectric surface of the drum 10 through a negative discharged corona element 13 which includes an electrical wire 15 and a beam directing plate 19 having an aperature 17. The modulated laser signals projected onto the drum 10 produce a negative discharge corona 20 which removes the positive charge in that particular area of the drum because the drum becomes a conductor in the presence of light. The result produced on the surface of the drum 10 is a series of dots that have no charge, or relatively low charge, compared to the positive charge on the rest of the drum surface.

As the drum 10 continues to rotate, the surface of the drum including the latent electrostatic image which was created by the modulated laser signals moves through a liquid developer 22 which is contained in a reservoir 24. The developer 22 includes a toner and a suitable liquid carrier or dispersant. The carrier may be a kerosene-like or other hydrocarbon material commonly known as Isopar. The toner particles in the developer are positively charged so that they tend to move in the imaged area on the surface of the drum which has the lowest positive charge.

After the image on the drum 10 is developed, the drum passes out of the liquid developer 22 and there is a layer of dispersant mixed with the toner image on the drum. It is at this point in the process that it is desirable to remove the excess dispersant. The drum surface with the excess dispersant is moved past a roller 26 which acts as a metering roller to limit the amount of the excess dispersant retained on the surface of the drum 10 as it rotates passed the position occupied by an air knife 28. As will be subsequently described, the roller 26 acting in conjunction with the air knife 28 returns the removed excess dispersant back to the reservoir 24.

Paper 30 is supplied from a stack 32. A source of negative transfer corona 34 creates a negative electrical charge on the back of the paper 30 which is opposite to the charge of the toner particles on the developed surface of the drum 10. The toner particles leave the drum and go to the paper. The paper 30 with the developed image thereon them moves adjacent a heater 36. The toner particles are melted by the heater 36 thereby becoming fixed to the paper. The paper 30 is then moved to an output paper stack 38. A cleaning station 40 includes a wiper element 41 in sliding contact with the drum 10. The wiper 41 cleans the toner particles which were not transferred to the paper 30 from the surface of the drum. Thus, the drum 10 is ready to receive the next image to be copied.

As illustrated more clearly in FIG. 2, the drum 10 is moved by suitable means, such as a motor, not illustrated, in a clockwise direction and the meter roller 26 is moved in a counterclockwise direction. A jet of air, illustrated by an arrow, from the air knife 28 is projected through a slit opening 42 which extends along the length of the drum 10, and in one preferred embodiment was on the order of ten inches. The jet of air impinges on the surface of the drum at an angle of approximately 45 degrees and produces a viscous drag which pulls the excess liquid, carrier, illustrated by a dashed line 43 from the surface of the drum 10. This angle serves to force the excess liquid carrier back towards the roller 26. The roller 26, moving in a counterclockwise direction, returns the excess liquid carrier removed by the air jet back to the reservoir in addition to the liquid carrier it removes by the metering action. Many of the previous air jet systems for removing excess liquid carrier have resulted in building up a dam of excess liquid carrier on the drum rather than forcing the liquid carrier back to a roller and return it to the reservoir. As mentioned, the roller 26 serves a dual function to meter the amount of liquid carrier which must be removed by the air knife 28 and to return the liquid carrier back to the reservoir 24.

In a preferred embodiment, the roller 26 was 0.630 inches in diameter with a clearance of 0.012 inches provided between the roller 26 and the surface of the drum 10. The clearance between the edge of the air knife slit 42 and the photoconductive surface of the drum 10 was on the order of 0.055 inches.

Figure 3:
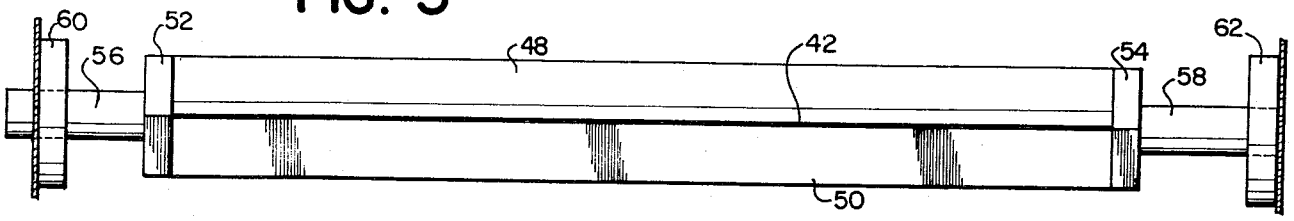
FIG. 3 is a view of an air knife structure, in accordance with the present invention.

The detailed structure of the air knife 28 will be described with reference to FIGS. 3 and 4, along with FIG. 2. The air knife 28 comprises an inner tube 44 and an outer enclosure 46 which is a diamond oriented, elongated member of substantially square cross-section constructed of two joined angular members, upper member 48 and lower member 50. The joined members 48 and 50 are secured to the inner tube 44 by a plurality of screws 49 and 51 located in spaced access ports along the length of the upper and lower angles of the enclosure 46 and engaged in corresponding threaded holes located along the length of the inner tube 44.

The inner tube 44 and the outer closure 46 are suitably mounted to a pair of end cap enclosures 52 and 54. Affixed to the outside surfaces of the end cap enclosures 52 and 54 are corresponding elements 56 and 58 that are fixedly connected to corresponding bases 60 and 62 which are attached to the housing structure of the reprographic machine. The element 56 is tubular so as to conduct pressurized air from a source (not illustrated) into an interior chamber 66 of the inner tube 44.

The inner tube 44 includes a plurality of spaced openings 64 as shown in FIG. 4. When the air under pressure is conducted into the inner tube 44, it passes through the openings 64 from the inner chamber 66 formed by the inner tube 44 into an outer chamber 68 formed by the outer surface of the tube 44 and the interior surface of the enclosure 46.

A pair of shims 70 and 72 are provided along the joining edges of the members 48 and 50. The shims are provided to assure precise measurement especially for the size of the nozzle at slit opening 42. In a preferred embodiment, this opening was 0.007 inches. Of course, with precise machining of the parts involved, the use of shims may be eliminated.

As illustrated in FIGS. 2 and 4, the lower member 50 includes an elongated groove 55 in the right upper surface in which is contained a plurality of spaced projections 53 at the inner portion of the groove 55. The outer portion of groove 50 is formed by a lip 57 which extends beyond the upper surface of the member 48. The projections 53 contact the adjacent surface of a shim 70 affixed to the member 48 to maintain the desired spacing between the edges of the members 48 and 50 and provide the slit opening 42 for the air jet. Air is projected between the tips of the members 48 and 50 through the groove 55 between the projections 53. The shim 70 is narrower than the shim 72 and rests on the projections 53. The slit opening 42 is unobstructed by the shim 70 since the shim does not extend sufficiently to block the opening 42. The projections 53 are small enough and sufficiently spaced so that a continuous air jet is projected against the drum 10. In the preferred embodiment with the length of the slit 42 being on the order of ten inches, the spacing between the projections was one and one quarter inches. The spaced projections also provide supports between the members 48 and 50 to maintain the slit opening constant therebetween.

It was found that 0.007 inches opening between the members 48 and 50 provides high efficiency with a minimum power requirement to produce an air jet sufficient to remove excess liquid without distorting the image on the drum. A smaller jet, for example, 0.005 inches, did not effectively remove the excess liquid. On the other hand, higher width jets, such as 0.009 or 0.010 inches tended to distort the image on the drum. Also, the power requirements for air flow became excessive when wide jets were used. The 0.007 inch jet makes it possible to keep within a relatively low blower capacity and reduce the required volume of air to remove the excess liquid. The 0.007 inch jet also provides relatively uniform distribution of the air across the length of the jet area.

Uniform air jet distribution is obtained by the air knife illustrated because of the control of the jet width and the uniformity of the applied pressure. The inner tube 44, with its inner chamber 66, acts as an annulus feeding into a larger volume into the chamber 69 of the outer enclosure 46. This arrangement provides a relatively constant pressure for the air jet projected through the slit opening 42. The arrangement illustrated allows time for air passing from the first chamber 66 to the second chamber 68 to settle out before the jet is produced. If the air were allowed to pass directly from the first chamber 66 through the slit opening, reduced air suction would result and the air could recombine in the first chamber 66. The series of holes 64 in the inner tube 44, which may be considered metering holes, are designed to produce a uniform pressure in the second chamber 68. The volume provided by the second chamber 68 is large enough so that the pressure therein is relatively stable. A typical pressure in the embodiment illustrated is about four to twelve inches of water air pressure. The energy in the pneumatic system is therefore very low.

We claim:

1. An air knife for projecting a jet of pressurized air through a slit opening towards a photoconductive surface on a rotatable drum having a liquid developer therefrom comprising:

an inner means providing a first chamber having a plurality of spaced openings, an outer means including a pair of angle members connected together surrounding said inner means to form a second chamber and said slit opening, one of said angle members including a slot with a plurality of projections disposed therein in contact with the other of said angle members to provide said slit opening, means for connecting said first chamber to a source of air pressure to cause pressurized air to enter into said first chamber, and pass through said spaced openings into said second chamber whereby a jet of pressurized air is projected through said slit opening towards said photoconductive surface.

2. In combination with an electrostatic reproduction machine utilizing a liquid developer made up of charged toner particles in a liquid carrier, a reservoir for containing said liquid developer, a drum providing a photoconductive surface adapted to receive a latent electrostatic image, and means for rotating said drum so that said photoconductive surface is passed through the liquid developer in said reservoir to develop the image on said drum, means for removing excess liquid carrier from said photoconductive surface after it has passed through said liquid developer comprising:

roller means disposed in close proximity to said drum to meter the amount of liquid carrier remaining on said photoconductive surface after it has passed through said liquid developer, an air knife for projecting a jet of pressurized air at said photoconductive surface at about a 45 degree angle with respect to said surface after it has passed said roller means to cause said liquid carrier to be directed towards said roller means, said air knife includes a relatively narrow slit opening of 0.007+0.001 inches extending longitudinally proximate said photoconductive surface for projecting a relatively uniform jet of pressurized air thereto, said roller means being disposed between said air knife and said reservoir to receive the liquid carrier resulting from said jet of pressurized air, said roller further being rotatable in an opposite direction to said drum so that the liquid carrier removed from the photoconductive surface by said jet of pressurized air is received by said roller and is carried away from the surface of said drum and returned downwardly to said reservoir.

* * * * *